US009074497B2

(12) United States Patent
Schulte

(10) Patent No.: US 9,074,497 B2
(45) **Date of Patent: *Jul. 7, 2015**

(54) CAMSHAFT PHASER HAVING A SPRING ATTACHED TO THE PIN OF A SCREW

(71) Applicant: Schaeffler Technologies AG & Co. KG, Herzogenaurach (DE)

(72) Inventor: Andreas Schulte, Erlangen (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/856,599

(22) Filed: Apr. 4, 2013

(65) Prior Publication Data

US 2013/0276735 A1 Oct. 24, 2013

(30) Foreign Application Priority Data

Apr. 18, 2012 (DE) ..... 10 2012 206 339

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34483* (2013.01)

(58) Field of Classification Search
CPC .. F01L 1/34; F01L 1/3442; F01L 2001/34483
USPC ..... 123/90.15, 90.17; 464/160
See application file for complete search history.

(56) References Cited

U.S. PATENT DOCUMENTS

| | | | | |
|---|---|---|---|---|
| 4,682,381 | A * | 7/1987 | Jordan et al. | 470/39 |
| 7,363,897 | B2 * | 4/2008 | Fischer et al. | 123/90.17 |
| 8,166,936 | B2 * | 5/2012 | Fujiyoshi | 123/90.17 |
| 2007/0000462 | A1 | 1/2007 | Lee et al. | |
| 2007/0215085 | A1 | 9/2007 | Imaizumi et al. | |

FOREIGN PATENT DOCUMENTS

| | | | |
|---|---|---|---|
| DE | 102008051755 | A1 | 4/2010 |
| JP | 2003120229 | A | 4/2003 |
| WO | WO 2011032610 | A1 * | 3/2011 |

* cited by examiner

*Primary Examiner* — Ching Chang
(74) *Attorney, Agent, or Firm* — Davidson, Davidson & Kappel, LLC

(57) ABSTRACT

A camshaft phaser (1) having a stator (2) and a rotor (16), whereby at least one cover (18) is attached to the stator (2) by means of at least one screw (5) that has a head (8), whereby a spring (14) is joined to the rotor (16) and to the screw (5) so as to transmit force, whereby the spring (14) is in contact with a pin (10) that has a polygonal outside shape and that extends lengthenwise from the head (8) of the screw (5).

17 Claims, 2 Drawing Sheets

CAMSHAFT PHASER HAVING A SPRING ATTACHED TO THE PIN OF A SCREW

This claims the benefit of German Patent Application DE 10 2012 206 339.0, filed Apr. 18, 2012 and hereby incorporated by reference herein.

The present invention relates to a camshaft phaser having a stator and a rotor, whereby at least one cover is attached to the stator by means of at least one screw that has a head, whereby a spring is joined to the rotor and to the screw so as to transmit force.

BACKGROUND

Devices to variably set the control timing of gas shuttle valves are employed in modern internal combustion engines so that the phase relation between a crankshaft and one or more camshafts can be established variably within a defined angular range, between a maximum early position and a maximum late position. Such devices are also referred to as camshaft phasers. These camshaft phasers have a stator that is joined to a gear wheel, for instance, in an integral construction or by means of a non-positive connection, a bonded connection and/or a positive connection in case of two separate components, whereby the gear wheel is connected to a driving means such as a traction mechanism that is configured, for example, as a belt or a chain.

Such camshaft phasers often employ wing nuts to adjust the rotor relative to the stator, thus influencing the gas shuttle valves by means of camshafts arranged concentrically to each other, whereby the one camshaft configured as a hollow shaft is joined to the stator while the other camshaft arranged concentrically thereto is joined to the rotor.

The state of the art, for instance, German patent application DE 10 2008 051 755 A1, also discloses similar camshaft phasers which are provided with a drive element, a driven element and a spring element in order to variably set the control timing of gas shuttle valves of an internal combustion engine. In this context, the drive element can be operationally engaged to a crankshaft of the internal combustion engine, whereby the driven element can be operationally engaged to a camshaft of the internal combustion engine, and is arranged so that it can pivot with respect to the drive element, whereby the spring element is supported on the driven element on the one hand and on the drive element on the other hand, whereby, by means of the spring element, the driven element can be provided with a torque relative to the drive element, and whereby the spring element is in contact with at least one pin that is configured so as to be separate from the driven element and from the drive element. This pin can be configured like a screw, whereby it has a shank having an external thread and a pin at a distance from it, into which a socket for a tool has been created. A spring element is bent outwards in the radial direction and is in contact with such a pin that is attached to a side cover.

A similar camshaft phaser is also disclosed in Japanese specification JP 2003/120229, whereby a spring element is attached to a hex key. This spring is arranged so as to lie like a spiral in a plane.

U.S. Pat. Publ. No. 2007/0215085 discloses a similar camshaft phaser in which a spring is attached to the head of a bolt.

The fact that a spring can also be attached between the external thread of the shank and the screw head is also disclosed in U.S. Pat. Appln. No. 2007/0000462 A1.

These prior-art camshaft phasers are used in internal combustion engines such as gasoline or diesel engines and are in operational contact with chain or belt drives. The spiral springs known, for example, from Japanese specification JP 2003/120229, which are used in camshaft amplifiers having a barrel-type design employed to compensate for camshaft friction torques.

SUMMARY OF THE INVENTION

Fundamentally speaking, however, the installation space available for spiral springs is limited. Moreover, the prior-art approaches entail several drawbacks. The known spring attachments require a considerable axial length and the screws used are relatively heavy. Moreover, the spring attachment often has to be implemented on separate components and, for example, a specially shaped pin has to be additionally employed, which increases the assembly costs and conceivably entails laborious processing of the screw.

It is an object of the present invention to provide a remedy for all of this, especially to reduce the weight, lower the consumption of material and cut back on component costs.

The present invention provides a camshaft phaser of the generic type in that the spring is in contact with a pin that has a polygonal outside shape and that extends lengthenwise from the head of the screw.

Such an approach is particularly conducive for hydraulic camshaft phasers since a pin designated as a force-application point on the head of the screw can be used for screwing in the screw as well as for implementing the spring attachment. A screw has to be provided with a force-application point anyway in order to apply the tightening torque. When this force-application point is employed to fasten the spiral spring, there is no need for additional parts or working steps. Since the force-application point is directly on the head surface of the screw, the axial installation space of the phaser is minimal.

The element designated here as a cover can be configured as a locking cover, a front cover, a rear cover, a reinforcement cover or a sealing cover. The cover can assume all of these functions.

Advantageous embodiments are claimed in the subordinate claims and will be elaborated upon below.

For instance, it is advantageous for the spring to be in contact with the pin with a positive fit. Then a precise attachment can be achieved and play can be avoided. Moreover, the service life of the aggregate is prolonged.

The use of a multi-toothed force-application point and the positioning of the phaser in a chain case causes a lubricant such as oil to accumulate between the spring that can be configured as a spiral spring and the pin, that is to say, the force-application point here. This has a positive effect on the wear behavior of the parts, which is why it is advantageous for the pin to have a multi-toothed design. In contrast to a force-application point having, for instance, an external hexagonal design, proper contact of the spring with its receptacle is ensured here.

The contact of the spring with the pin is particularly good if the pin has a TORX or TORX-PLUS external shape. This then establishes contact over the surface between the spiral spring and the outside of the pin in the area of the attachment. High punctual pressures are thus prevented, which contributes to improving the load-bearing capacity.

It is further advantageous if the pin has cylindrical segments in the area of its largest radial extension.

It is likewise advantageous for the side of the screw head facing the stator to be configured conically. Particularly the configuration as a countersunk head screw allows the screws to be employed to center the cover, so that the cover is self-centering. This means that the cover sits more precisely on its seat, thus preventing leakage.

It has proven to be especially advantageous for the cone on the side of the screw head facing the stator to have an angle measuring between 90° and 94°, preferably 92.5°.

An advantageous embodiment is characterized in that the pin has an axial length that is less than three times as long as the axial length of the screw head, but more than two times as long as the axial length of the screw head.

In order to utilize proven stator configurations, it is advantageous for the stator to have a barrel-type design and for it to have a bottom on its side facing away from the cover for purposes of improving its variability for different internal combustion engines, or else for the stator to have a sleeve-like design and an additional cover on the side facing away from the cover.

The installation space can be utilized particularly efficiently when the spring is configured as a spiral spring that lies in a plane.

BRIEF DESCRIPTION OF THE DRAWINGS

The invention will be explained in greater detail below with reference to a drawing that depicts a first embodiment. The following is shown.

DETAILED DESCRIPTION

Figure 1:
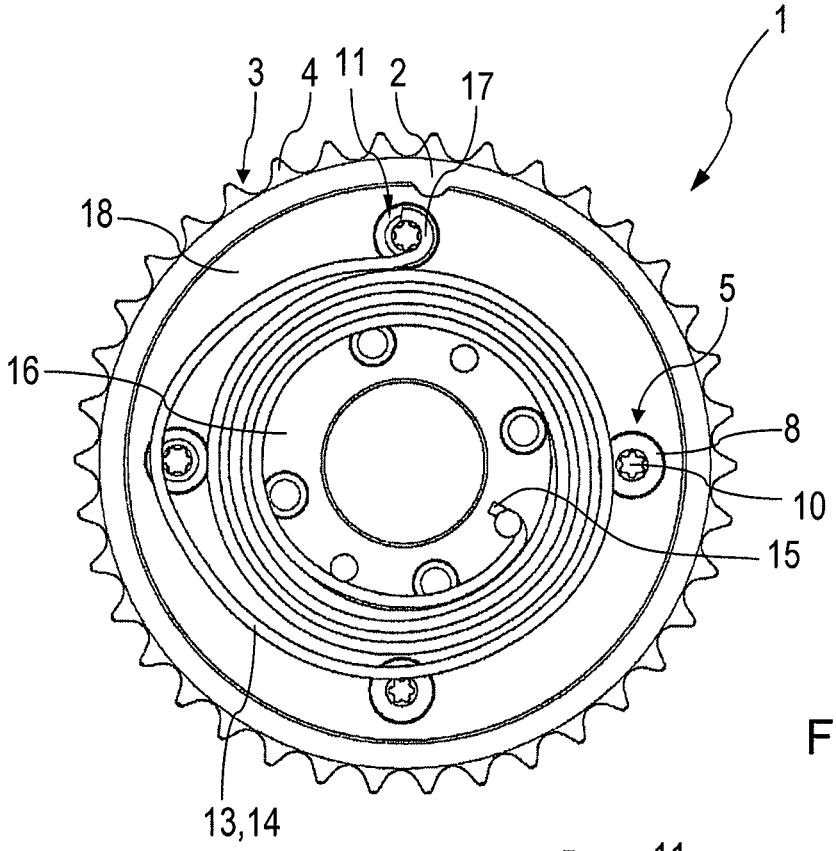
FIG. 1: a front view of a camshaft phaser according to the invention.

The figures are merely of a schematic nature and serve only to elucidate the invention. The same elements are designated by the same reference numerals.

FIG. 1 shows an inventive embodiment of a camshaft phaser 1. The camshaft phaser 1 has a stator 2 as well as a rotor 16.

The stator 2 can also have as an integral part a gear wheel 3 with external teeth 4. The gear wheel 3, however, can also be installed on the stator 2 as a separate component and can be non-rotatably joined to the stator 2. For example, screws 5, four of which are employed in the embodiment according to FIG. 1, are an option for this purpose.

Figure 3:
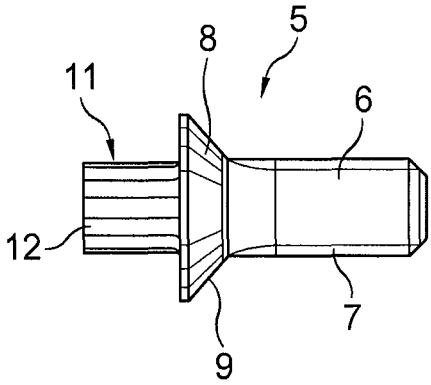
FIG. 3: one of the screws of the camshaft phaser shown in FIGS. 1 and 2, to which the spring is attached, in a singular view from the side.

The screw 5 has a shank 6 with an external thread 7, as can be clearly seen in FIG. 3. In particular, it can be seen that, at one end of the shank 6, the screw 5 has a head 8 that has a cone 9 on its side facing the shank 6. The cone 9 has an opening angle of 92.5° although it can also be 93.5° or 91.5°.

A pin 10 that has a muti-toothed profile 11 on its outside is configured on the side of the screw head 8 facing away from the shank 6. Individual teeth of the muti-toothed profile 11 are shaped so as to be convex, especially cylindrical, on their outside, in order to create a TORX-PLUS equivalent. The muti-toothed profile 11 creates the multi-toothed shape.

The outer contour of the muti-toothed profile 11 of the pin 10 is configured in the form of a TORX profile or of a TORX-PLUS profile.

A spring 14 configured and arranged as a spiral spring 13 has a first end 15 that is attached to the rotor 16. The first end 15 of the spring 14 can be fastened to a pin of the rotor 16 provided for this purpose or, alternatively, it can project into an appropriately shaped groove.

Figure 2:
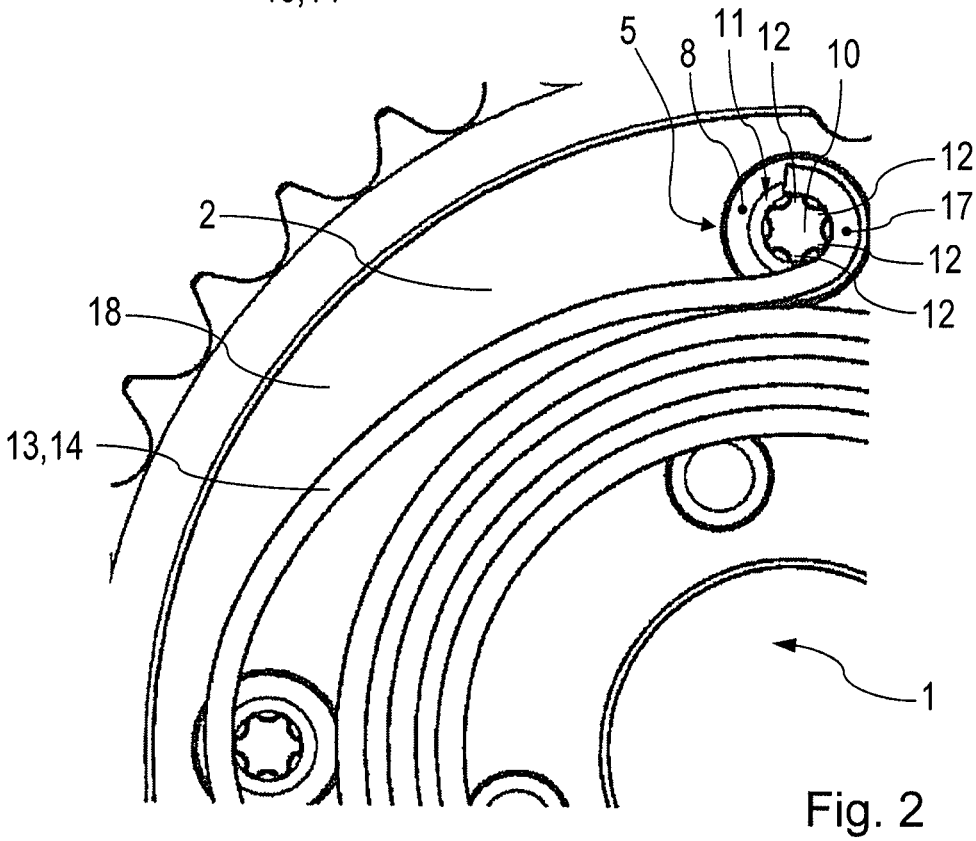
FIG. 2: a section from FIG. 1 for purposes of better illustrating the attachment of the spring to the screw with the pin.

It can be clearly seen in FIG. 2 that a second end 17 of the spiral spring 13 is in contact with the outer contour of the pin 10, namely, on the teeth 12. This creates a positive fit.

Figure 4:
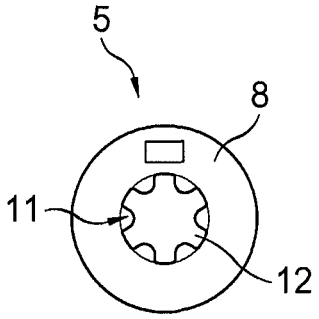
FIG. 4: a top view of the screw from FIG. 3, with the pin projecting axially from the screw head.

The screw 5 is shown in a side view in FIG. 3 and in a top view in FIG. 4. It is precisely the combination of the conical underside of the screw head with the pin 10 which projects axially from the screw head 8 and which has a TORX-PLUS outer contour that has proven to be particularly advantageous.

The four screws 5, as depicted in FIG. 1, pass through a cover 18 that is screwed onto the stator 2 via the screws 5.

The axial length of the screw head is determined by the transition area from the pin 10 to the screw head 8 and by the transition area from the screw head 8 to the shank 6, in contrast to which the axial length of the pin 10 is determined between the transition area from the pin 10 to the screw head 8 and the end of the screw 5 facing away from the shank 6.

LIST OF REFERENCE NUMERALS

1 camshaft phaser
2 stator
3 gear wheel
4 teeth
5 screw
6 shank
7 external thread
8 screw head
9 cone
10 pin
11 muti-toothed profile
12 tooth
13 spiral spring
14 spring
15 first end
16 rotor
17 second end
18 cover

What is claimed is:

1. A camshaft phaser comprising:

a stator;

a rotor;

at least one screw having a head, a shank extending lengthwise from the head in a first direction and a pin extending lengthwise from the head in a second direction opposite the first direction, the pin having a polygonal outside shape;

at least one cover attached to the stator via the at least one screw, the shank of the at least one screw extending into the cover, the head contacting the cover, the pin extending away from the cover; and a spring joined to the rotor and to the screw so as to transmit force, the spring being in contact with the pin via the polygonal outside shape.

2. The camshaft phaser as recited in claim 1 wherein the spring contacts the pin with a positive fit.

3. The camshaft phaser as recited in claim 1 wherein the pin has a multi-toothed shape.

4. The camshaft phaser as recited in claim 1 wherein the pin has a TORX or TORX-PLUS external shape.

5. The camshaft phaser as recited in claim 1 wherein the pin has cylindrical segments in an area of a largest radial extension.

6. The camshaft phaser as recited in claim 1 wherein a side of the screw head facing the stator is configured conically to define a cone.

7. The camshaft phaser as recited in claim 6 wherein the cone has an angle measuring between 90° and 94°.

8. The camshaft phaser as recited in claim 7 wherein the angle is 92.5°.

9. The camshaft phaser as recited in claim 1 wherein the pin has an axial length that is less than three times as long as an axial length of the screw head, but more than two times as long as the axial length of the screw head.

10. The camshaft phaser as recited in claim 1 wherein the stator has a barrel design and a bottom on a side facing away from the cover, or the stator has a sleeve design and an additional cover on the side facing away from the cover.

11. The camshaft phaser as recited in claim 1 wherein the spring is a spiral spring lying in a plane.

12. The camshaft phaser as recited in claim 1 wherein a radial outer end of the spring is wrapped around a portion of the pin.

13. The camshaft phaser as recited claim 12 wherein the spring includes a radial outer end and a radial inner end with respect to a center axis of the camshaft phaser, the pin including teeth that contact the radial outer end of the spring to create a positive fit.

14. The camshaft phaser as recited in claim 1 wherein the head extends radially outward with respect to a center axis of the screw past the pin and the shank.

15. The camshaft phaser as recited in claim 1 wherein the pin is configured as a force-application point of the screw for screwing in the screw.

16. The camshaft phaser as recited in claim 1 wherein the screw is configured as a countersunk head screw such that the at least one screw centers the cover.

17. The camshaft phaser as recited in claim 1 wherein the shank has an external thread.

* * * * *